US006205599B1

(12) United States Patent
Anders

(10) Patent No.: US 6,205,599 B1
(45) Date of Patent: Mar. 27, 2001

(54) COVERED EYEWASH FOUNTAIN

(75) Inventor: Allan D. Anders, Sealy, TX (US)

(73) Assignee: Encon Safety Products, Houston, TX (US)

( * ) Notice: Subject to any disclaimer, the term of this patent is extended or adjusted under 35 U.S.C. 154(b) by 0 days.

(21) Appl. No.: 09/566,821

(22) Filed: May 8, 2000

(51) Int. Cl.[7] ..... A61H 33/00
(52) U.S. Cl. ..... 4/620
(58) Field of Search ..... 4/620

(56) References Cited

U.S. PATENT DOCUMENTS 3,413,660 * 12/1968 Lagarelli et al. ..... 4/620
3,599,251 * 8/1971 Wright ..... 4/620
5,008,963 * 4/1991 Stein ..... 4/620

FOREIGN PATENT DOCUMENTS

2271056 * 6/1994 (GB) ..... 4/620

* cited by examiner

*Primary Examiner*—Charles E. Phillips
(74) *Attorney, Agent, or Firm*—Jenkens & Gilchrist. P.C.

(57) ABSTRACT

A push plate for moving a flow control valve in a covered eye wash fountain is interconnected with a cover whereby opening the flow control valve also opens the cover while simultaneously providing independent opening and closure of the cover without moving the push plate, and simultaneously providing closure of the flow control valve from an open position without closing the cover. The covered eyewash fountain embodying the present allows the cover to be raised and the fountain inspected, cleaned, serviced, or repaired without opening the flow control valve.

5 Claims, 4 Drawing Sheets

COVERED EYEWASH FOUNTAIN

BACKGROUND OF THE INVENTION

1. Technical Field

This invention relates generally to a covered fountain for flushing contaminants from eyes, and more particularly to such a fountain that automatically raises the cover from the fountain and initiates a flow of rinsing fluid through at least one spray head in response to activating a push plate.

2. Background Art

Eyewash fountains are typically used in industrial and laboratory environments to provide emergency flushing of human eyes after exposure to fumes, liquids or airborne debris that may be injurious to the eyes. Many of these devices require that an affected individual locate and turn on a valve to initiate a flow of rinsing water. Sometimes the affected individual may even be required to modulate the valve to provide a stream of water at a desirable pressure and in an appropriate volume.

Emergency eyewash fountains, by the very nature of their intended use, often may go for several months, or longer, without use. This infrequent use permits rust, corrosion, bacteria and other undesirable materials to accumulate in the spray heads and supply lines. Examples of covered eyewash fountains that open automatically in response to activating a push plate that simultaneously initiates a flow of water and opens the cover are disclosed in U.S. Pat. No. 3,599,251 issued Aug. 17, 1971 to Allan C. Wright and entitled *Covered Eyewash Fountain* and U.S. Pat. No. 5,008,963 granted on Apr. 23, 1991 to Matthew I. Stein entitled *Emergency Wash Station*. Both of the above-referenced arrangements have a mechanical linkage between a flow control valve and the cover whereby the cover is pushed to an open position in response to opening the valve, and lowered to a closed position in response to closing the valve. In both arrangements, the cover cannot be raised without initiating a flow of water. Therefore, if it is desired to inspect, service, repair or otherwise access any component of the water distribution system enclosed within the fountain without a flow of water, the mechanical linkage between the flow control valve and the cover must first be disconnected.

The present invention is directed to overcoming the problems set forth above. It is desirable to have a covered eyewash fountain in which the cover can be raised for access to the spray heads, plumbing, and other fixtures disposed within the fountain without opening a flow control valve or disassembly of a linkage that automatically opens the cover in response to opening the flow control valve. It is also desirable to have such a covered eyewash fountain in which the water flow may be adjusted, or even stopped all together, after opening the cover in response to initiating flow through the water control valve by operation of a push plate, without moving the cover toward a closed position. It is also desirable to have such a covered eyewash fountain in which independent opening and closure of the cover can be carried out without moving a push plate connected to a stem of the flow control valve.

SUMMARY OF THE INVENTION

In accordance with one aspect of the present invention, an eyewash fountain comprises a basin having at least one upperly directly nozzle disposed in the basin, a cover disposed over the basin, and a flow control valve, movable between an open and a closed position, in fluid communication with the nozzle. The eyewash fountain further includes a push plate operatively connected to the flow control valve and selectively movable between a first position and a second position. The flow control valve is moved to its closed position in response to moving the push plate to the first position. The flow control valve is moved to its open position in response to moving the push plate to the second position. The covered eyewash fountain further includes a means for opening the cover in response to moving the push plate to the second position, and simultaneously independently opening and closing the cover without moving the push plate, and simultaneously providing closure of the flow control valve without closing the cover.

Other features of the eyewash fountain embodying the present invention include the cover being pivotally attached to the basin at a predetermined position along a peripheral edge of the cover, and the means for opening the cover in response to moving the flow control valve to an open position and simultaneously providing other functions, as described above, comprises a linkage having a first end attached to the push plate and a second end attached to the cover at a position adjacent the predetermined position along the peripheral edge of the cover at which the cover is pivotally connected to the basin. The linkage pulls the cover to an open position in response to moving the push plate to the second position. Other features includes the linkage comprising a pair of bar links, a first link of the pair having a first end pivotally attached to the push plate and a second end pivotally connected to the second link of the pair. The second end of the second bar link is pivotally attached to the cover.

Other features include the flow control valve having a stem on which the push plate is fixedly attached whereby rotation of the push plate produces a corresponding rotation of the flow control valve, and the first end of the linkage extending between the push plate and the cover is attached to the push plate at a position spaced from the flow control valve stem. Yet another feature includes the linkage being a flexible member having a length defined by the distance between the respective attachment points of the first end to the push plate and the second end to the cover when the push plate is at the first position and the cover is closed.

BRIEF DESCRIPTION OF THE DRAWING

A more complete understanding of the structure and operation of the present invention may be had by reference to the following detailed description when taken in conjunction with the accompanying drawings, wherein.

DETAILED DESCRIPTION OF A PRESENTLY PREFERRED EXEMPLARY EMBODIMENT

Figure 1:
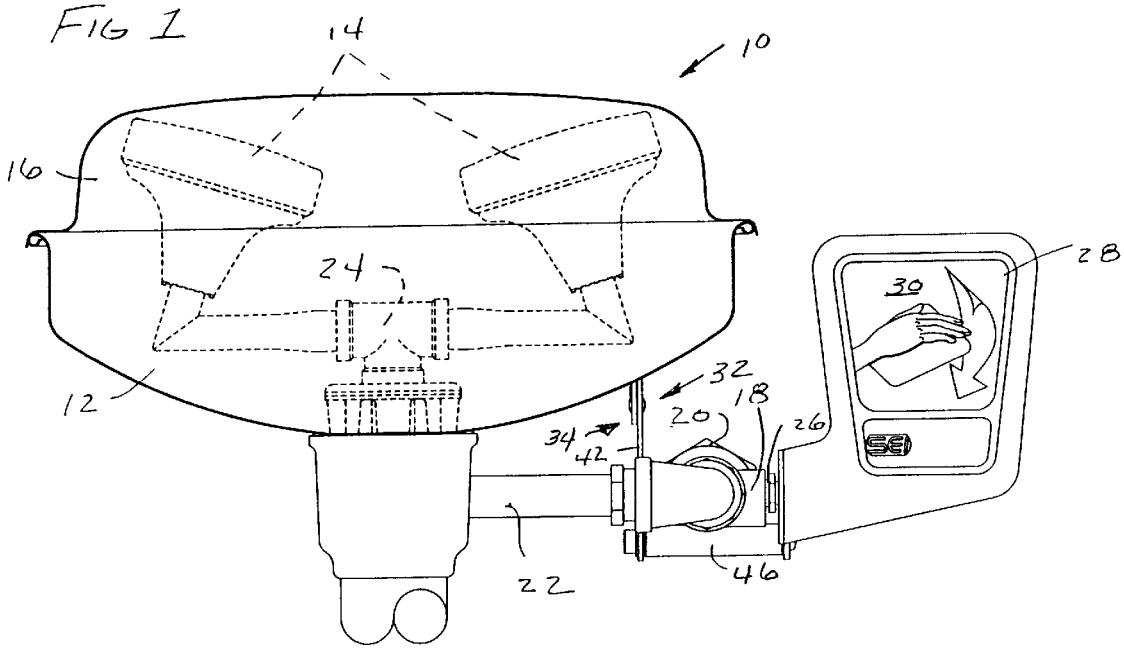
FIG. 1 is a front view of a covered eyewash fountain embodying the present invention, showing both the cover and a flow control valve in closed positions.

A covered eyewash fountain embodying the present invention is generally indicated in each of the drawings by the reference numeral 10. The eyewash fountain 10 has a basin 12 having at least one, and preferably two, upwardly directed nozzles 14, covering both eyes, positioned in the basin 12. A protective cover 16 is disposed over the basin 12 and cooperates with the basin 12 to form an enclosure about the nozzles 14. More specifically, the cover 16 is pivotally attached to the basin 12 at a predetermined position along respective peripheral edges of the cover 16 and basin 12, such as at the rear of the basin 12 as illustrated in the drawings.

A flow control valve 18 is in fluid communication with a water supply by way of an inlet pipe 20, and an outlet pipe 22 that is connected to a T-manifold 24 on which the nozzles 14 are mounted. Thus the flow control valve 18 is in fluid communication with the nozzles 14. The flow control valve 18 is movable between an open and a closed position in response to rotating a valve stem 26 operatively connected to an internal ball or gate component of the valve 18.

Figure 2:
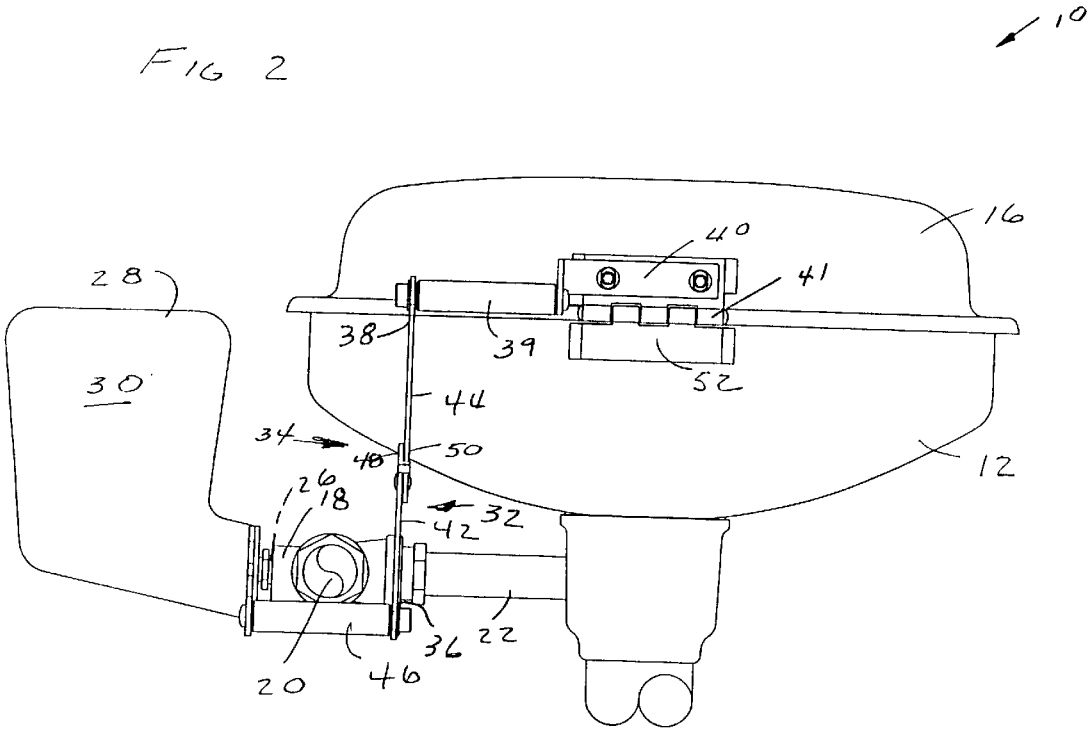
FIG. 2 is a rear view of the covered eyewash fountain embodying the present invention, showing both the cover and the flow control valve in closed positions, as illustrated in FIG. 1.
Figure 3:
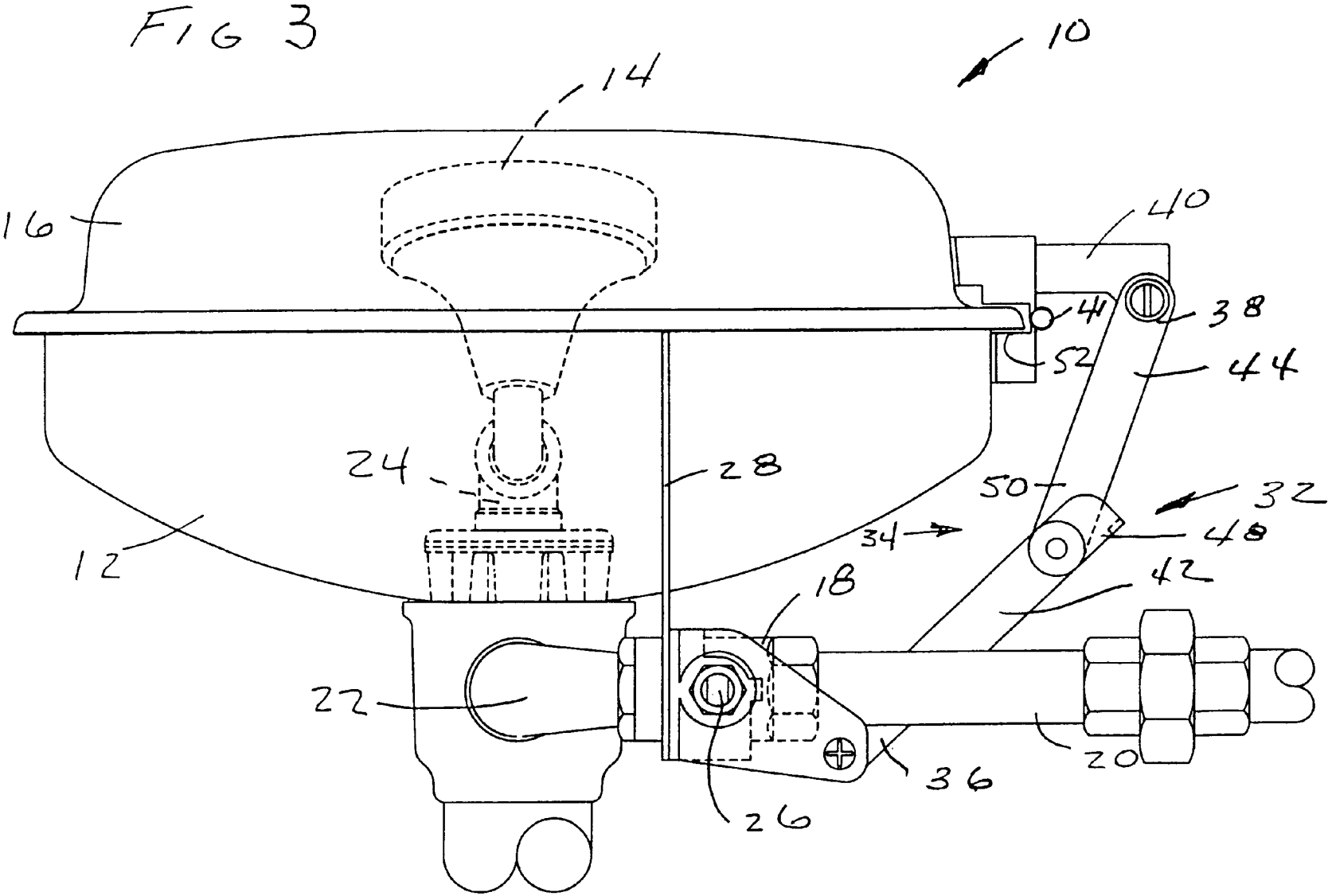
FIG. 3 is a side view of the covered eyewash fountain embodying the present invention, showing both the cover and the flow control valve in closed positions, as illustrated in FIG. 1.
Figure 4:
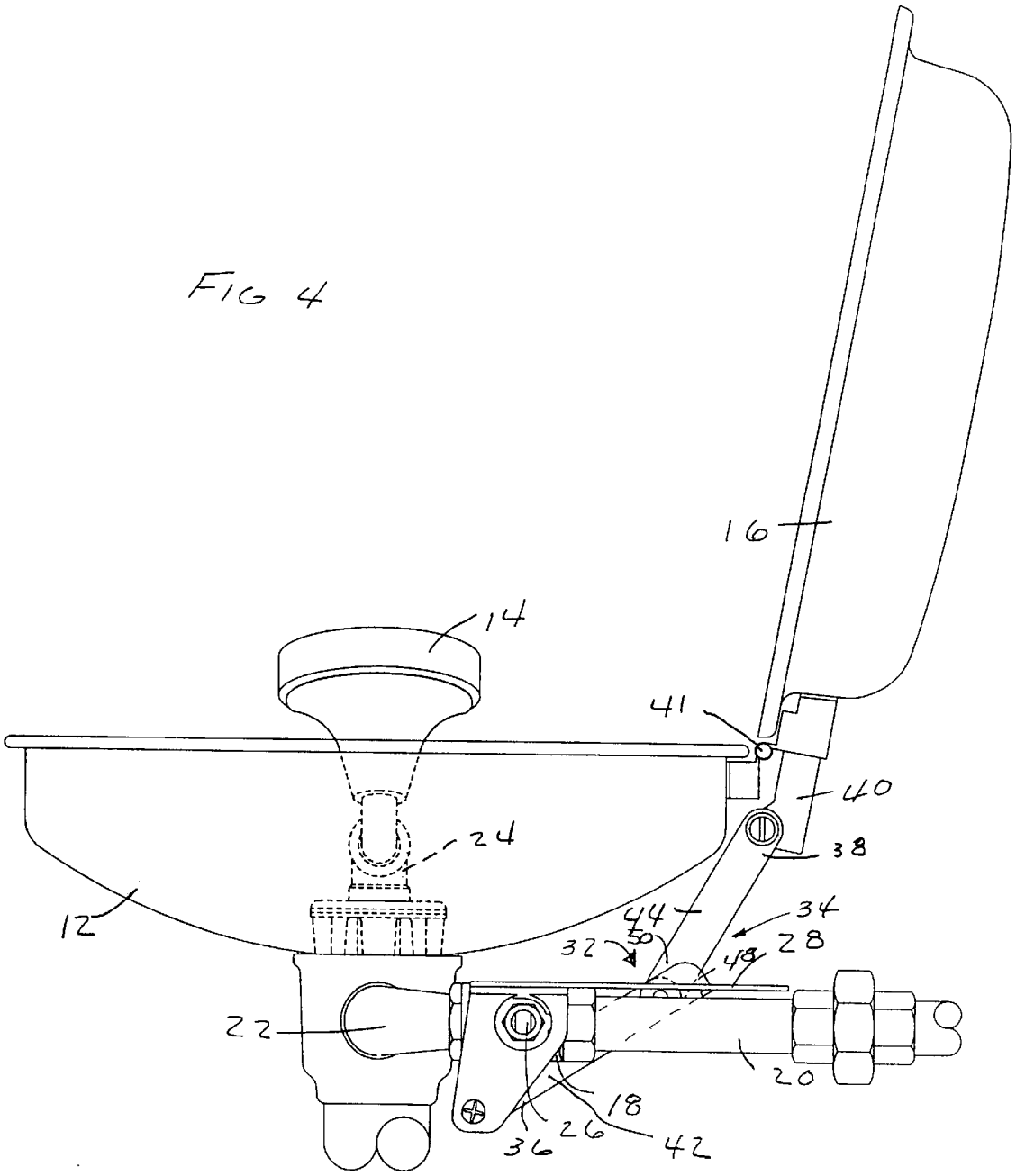
FIG. 4 is a side view of the covered eyewash fountain embodying the present invention, showing both the cover and the flow control valve in open positions.

A push plate 28 having a readily visible and easily accessible enlarged flat area 30 is fixedly mounted on the valve stem 26 of the flow control valve 18 whereby movement of the flat area 30 of the push plate 28 causes the push plate to rotate the stem 26. The push plate 28 is movable between a first position, as illustrated in FIGS. 1–3 and 5, and a second position as illustrated in FIG. 4. At the first position of the push plate 28, the push plate 28 is vertically disposed and the flow control valve 18 is closed. At the second position of the push plate 28, the push plate 28 is horizontally disposed and the flow control valve 18 is open. The flow control valve 18 is closed in response to moving the push plate 28 to the first position, and the flow control valve 18 is opened in response to moving the push plate 28 to the second position.

The covered eyewash fountain 10 further includes a means 32 for opening the cover 16 and moving the flow control valve 18 to an open position in response to moving the push plate 28 to the second position, and simultaneously providing independent opening and closure of the cover 16 without moving the push plate 28, and simultaneously providing closure of the flow control valve 18 without closing the cover 16. In the illustrated embodiment, the means for simultaneously carrying out the above-described functions comprises a linkage 34 having a first end 36 attached to the push plate 28 at a position spaced from the position of which push plate 28 is attached to the stem 26 of the valve 18. A second end 38 of the linkage 34 is attached to the cover 16 by way of a first spacer 39 positioned between the second end 38 and a bracket 40 attached to the peripheral edge of the cover 16 at a position adjacent a pivot connection 41 of the cover 16 to the basin 12. As best illustrated in FIGS. 2–5, the bracket 40 is attached to the cover 16 and one arm of a hinge 52 which provides the pivot interconnection 41 between the cover 16 and the basin 12. By moving the push plate 28 from its first position, as illustrated in FIGS. 2 and 3 to its second position, as illustrated in FIG. 4, it can be seen that the linkage 34 pulls the cover 16 to an open position.

In the illustrated embodiment, the linkage 34 comprises a pair of bar links 42, 44. The first end 36 of the first bar link 42 is pivotally attached to the push plate 28 by a second spacer 46 that is respectively pivotally attached at its ends to the push plate 28 and the first end 36 of the linkage 34. A second end 48 of the first bar link 42 is pivotally interconnected with a first end 50 of the second bar link 44. As described above, the second end 38 of the second bar link 44 is pivotally attached through the first spacer 39 to the bracket 40 that is attached to the outer peripheral edge of the cover 16 at a position adjacent to the pivot connection 41 of the cover 16 to the basin 12.

Thus, when the push plate 28 is moved from its first position, as illustrated in FIG. 3 to its second position as illustrated in FIG. 4, as may be encountered in an emergency use situation, the flow control valve 18 is opened, as a result of rotating the stem 26 attached to the push plate 28, and the cover 16 is pulled to its open position by the linkage 34 interconnecting the push plate 28 and the cover 16.

Figure 5:
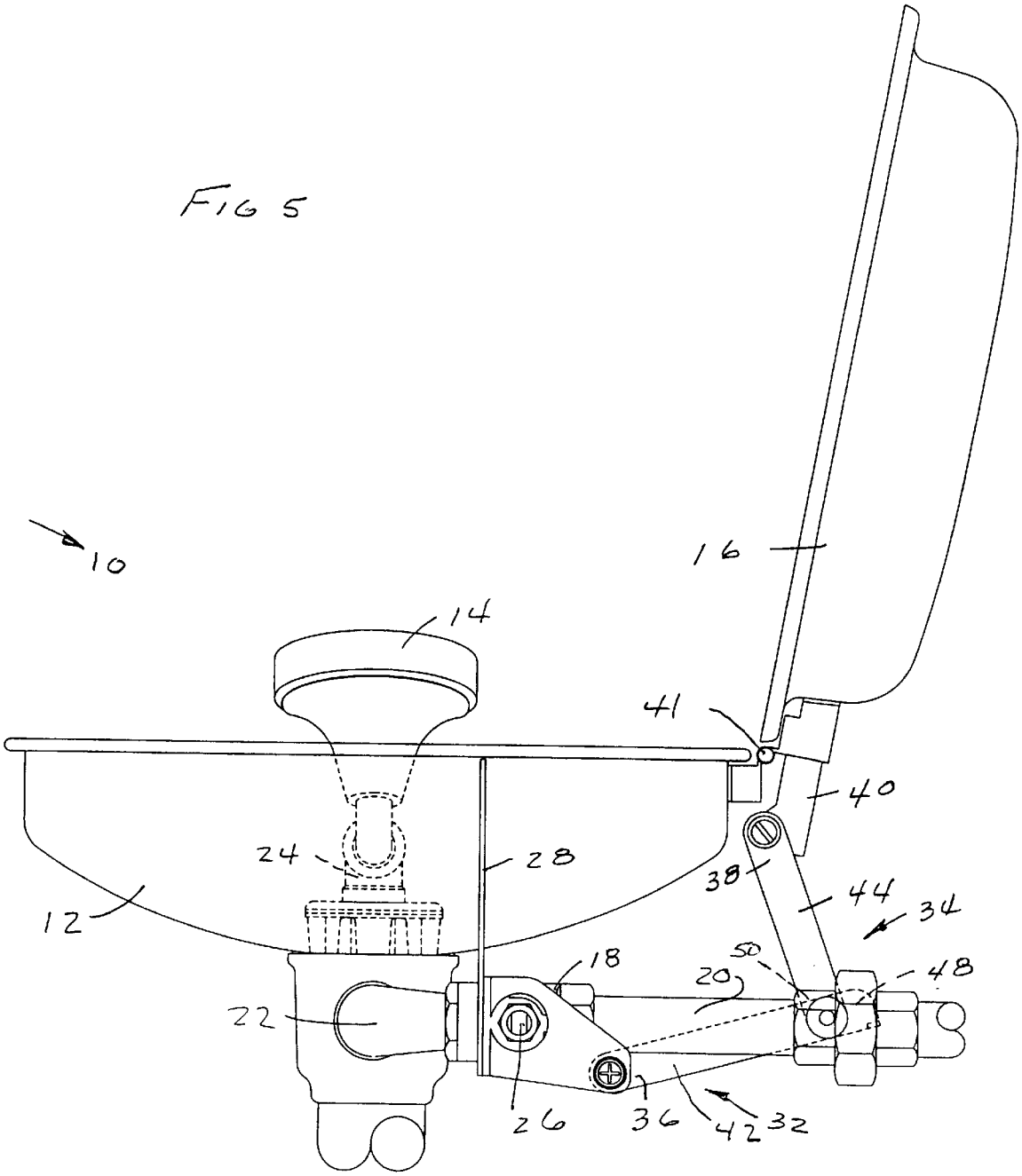
FIG. 5 is a side view of the covered eyewash fountain embodying the present invention, showing the cover in an open position and the flow control valve in a closed position.

Furthermore, the linkage 34 permits the push plate 28 to be moved from its second position whereat the flow control valve 18 is open, back to its first position whereat the flow control valve 18 is closed, as illustrated in FIG. 5, without closing the cover 16. Moreover, the cover 16 can be independently moved from its closed position, as illustrated in FIG. 3, to its open position, as illustrated in FIG. 5, without moving the push plate 28 from its first position at which the flow control valve 18 is closed. This important advantage allows the fountain and enclosed nozzles and plumbing to be inspected, cleaned, serviced, or repaired without opening the flow control valve 18, or disconnecting the linkage 34 between the push plate 28 and the cover 16. Heretofore, this has been impossible with the prior linkage arrangements interconnecting a flow control valve and a cover. After closure of the flow control valve 18, as the result of moving the push plate 28 from its second to its first position, as illustrated respectively in FIGS. 4 and 5, water flow through the nozzles 14 is terminated and the cover 16 may be manually returned it to its closed position over the basin 12.

It can also be readily seen that the means 32 for opening the cover 16 and moving the flow control valve 18 to an open position in response to moving the push plate 28 to the second position, and simultaneously providing independent opening and closure of the cover 16 without moving the push plate 28, and simultaneously providing closure of the flow control valve 18 without closing the cover 16 may be provided by a flexible linkage, such as a small chain linkage, cable, cord, or similar limber member having respective ends connected to the push plate 28 at a position spaced from the stem 26 and to the bracket 40 of the cover 16. The flexible linkage should have a length that is determined by the distance between the respective attachment points at the push plate 28 and the cover 16 when the push plate 28 is at its first position and the cover 16 is closed. Thus, when the push plate 28 is moved it its second position, thereby opening the flow control valve 18, the flexible linkage pulls the cover to its open position. Also, it can be readily understood that when the push plate 28 is at its first position, and the flow control valve 18 closed, the flexible linkage will become slack and the cover 16 can be opened and closed without moving the push plate 28 away from its first position. When the push plate 28 is at its first position, and the cover is open, the flexible linkage will be relaxed. Also, because the flexible linkage will be in its relaxed state when the push plate 28 is at its second position, with the control valve 18 closed and the cover 16 at its open position, the push plate 28 can be moved to its first position, thereby closing or modulating the flow control valve 18 without closing the cover 16.

Thus it can be readily seen that the covered eyewash fountain 10, embodying the present invention has a protective cover 16, disposed over the spray nozzles 14, which can be moved to its open position in response to moving the push plate 28 to its horizontal position, whereby the flow control valve 18 is also opened and a flow of water discharged through the nozzles 14. Also, if desired, when the flow control valve 18 is closed and the push plate 28 is in its first, or vertical, position the cover 16 can be raised without initiating a flow of water through the nozzles 14. Furthermore, in the covered eyewash fountain 10 embodying the present invention, the flow control valve 18 can be modulated or closed, by moving the push plate 28 from its horizontal to its vertical position, without closing the cover 16. These multiple independent operations of the cover and the flow control valve 18 permit the covered eyewash fountain 10 to be easily inspected, cleaned, serviced, or repaired with the cover 16 open and the flow control valve 18 closed.

Although the present invention is described in terms of preferred exemplary embodiments, with specific linkage arrangements described herein, those skilled in the art will recognize that changes in those linkage arrangements, which would not compromise the multiple functional relationship of the linkage between the cover and the flow control valve, may be made without departing from the spirit of the invention. For example, the push plate may be interconnected with a foot-operated pedal, if so desired. Moreover, the specific linkage described and claimed herein may be connected to a flow control valve that not only controls fluid flow to eye nozzles disposed in a basin, but may also control fluid flow to a shower head. In such installations, a foot-operated pedal, a platform, may act as the push plate. In yet other arrangements, the cover 16 may be pivotally attached to the vertical riser of the shower head. Such changes are intended to fall within the scope of the following claims. Other aspects, features, and advantages of the present invention may be obtained from a study of this disclosure, along with the appended claims.

ELEMENT LIST

10 Covered Eyewash Fountain
12 basin
14 nozzles
16 cover
18 flow control valve
20 inlet pipe
22 outlet pipe
24 T-manifold
26 Stem (of 18)
28 push plate
30 flat area
32 means (multi-function)
34 linkage
36 first end (of 34)
38 second end (of 34)
39 first spacer (between 38 and 40)
40 bracket (at edge of 16)
41 pivot connection (16 to 12)
42 first bar link
44 second bar link
46 second spacer (between 28 and 36)
48 second end (of 42)
50 first end (of 44)
52 hinge

What is claimed is:

1. An eyewash fountain, comprising:

a basin having at least one upwardly directed nozzle disposed therein;

a cover disposed over said basin and cooperating with said basin to form an enclosure about said nozzle;

a flow control valve in fluid communication with said nozzle and movable between an open position and a closed position;

a push plate connected to said flow control valve and selectively movable between a first position and a second position, said flow control valve being moved to said closed position in response to moving said push plate to the first position, and said flow control valve being moved to said open position in response to moving said push plate to the second position; and a means for opening said cover disposed over said basin and moving said flow control valve to an open position in response to moving said push plate to the second position, and simultaneously providing independent opening and closure of said cover without moving said push plate, and simultaneously providing closure of said flow control valve by moving said push plate from the second to the first position without closing said cover.

2. The eyewash fountain, as set forth in claim 1, wherein:

said cover is pivotally attached to said basin at a predetermined position along a peripheral edge of the cover; and said means for opening said cover disposed over said basin and moving said flow control valve to an open position in response to moving said push plate to the second position, and simultaneously providing independent opening and closure of said cover without moving said push plate, and simultaneously providing closure of said flow control valve by moving said push plate from the second to the first position without closing said cover comprises a linkage having a first end attached to said push plate and a second end attached to said cover at said position adjacent the predetermined position along the peripheral edge of the cover, said linkage pulling the cover to an open position in response to moving said push plate to the second position.

3. The eyewash fountain, as set forth in claim 2, wherein said linkage comprise a first bar link and a second bar link, said first bar link having a first end pivotally attached to said push plate and a second end pivotally interconnected to a first end of said second bar link, and a second end of said second bar link being pivotally attached to the cover at said position adjacent the predetermined position along the peripheral edge of the cover.

4. The eyewash fountain, as set forth in claim 2, wherein said flow control valve has a stem and said push plate is fixedly attached to said stem whereby rotation of the push plate produces a corresponding rotation of the flow control valve stem, and said first end of the linkage extending between the push plate and the cover is attached to said push plate at a position spaced from the flow control valve stem.

5. The eyewash fountain, as set forth in claim 2, wherein said linkage comprises a flexible member having a first end attached to said push plate and a second end attached to said cover at said position adjacent the predetermined position along the peripheral edge of the cover, said flexible linkage having a length defined by the distance between the respective attachment points of the first and second ends when the push plate is at said first position and said cover is closed.

* * * * *